United States Patent [19]

Robeson et al.

[11] 4,041,829

[45] Aug. 16, 1977

[54] PIANO PEDAL ASSEMBLY

[76] Inventors: Robert Ogden Robeson, Boiceville, N.Y. 12412; Vincent Joseph Hart, 4 Smith Ave., Kingston, N.Y. 12401

[21] Appl. No.: 618,054

[22] Filed: Sept. 30, 1975

[51] Int. Cl.[2] ..... G10C 3/26

[52] U.S. Cl. ..... 84/225; 84/228

[58] Field of Search ..... 84/225, 228, 435, 452 P

[56] References Cited

U.S. PATENT DOCUMENTS

| | | | |
|---|---|---|---|
| 755,102 | 3/1904 | Bosenbury | 84/225 |
| 1,194,311 | 8/1916 | Norris | 84/225 |
| 2,913,284 | 11/1959 | Zankl | 84/452 P |
| 3,365,994 | 1/1968 | Rutherford et al. | 84/228 |

*Primary Examiner*—Stephen J. Tomsky
*Attorney, Agent, or Firm*—Joseph J. Connerton

[57] ABSTRACT

In a piano pedal assembly adapted to control the duration and amplitude of musical tones or notes generated by a piano, the individual pedals of the assembly when attached to the piano, are maintained in their normal position under pressure and adapted when depressed to pivot about a pin. The assembly is mounted on a support such as a base plate, and a pair of pedal mounting blocks having a cylindrical opening, for securing opposite sides of the pivot pin, are mounted within openings in the base plate. The pedal mounting blocks are formed from a low friction material such as Nylon or Teflon and function to provide and maintain precise registration of the individual pedals within the assembly. The piano pedal assembly utilizes fewer and less complex parts and components than prior art assemblies whereby the assembly time and fabrication cost of pedal assemblies are substantially reduced.

10 Claims, 4 Drawing Figures

PIANO PEDAL ASSEMBLY

BACKGROUND OF THE INVENTION

In a stringed percussion instrument such as a piano, musical tones or notes are generated by depression of individual keys in the keyboard which actuates felt covered hammers to strike steel wires to generate musical notes. Another criterial of piano playing relates to the duration of the tone or tones. A pedal assembly comprises two or more foot pedals, one of which is adapted to selectively sustain one or more notes, while the second functions to muffle tones. Since pianos are designed for use over long term periods, it is essential that the pedal assembly be designed for noise free and trouble free operation and possess extended life capabilities.

As more fully described hereinafter, conventional piano pedal assemblies are relatively complex. In one pedal assembly known in the art, a three step forming operation is required to form the pedal mounting bracket, while individual clips are utilized on each side of the pedal to secure the pedal pivot pin in position. Prior to fastening these clips to the mounting bracket, it was necessary to manually mount bushings over each side of the pins prior to clamping the pedals to the base plate. The complexity and number of parts and steps in the assembly process resulted in increased cost and assembly time.

SUMMARY OF THE INVENTION

In accordance with the present invention, there is provided an improved piano pedal assembly which utilizes a smaller number of less complex parts to facilitate assembly at reduced cost while providing improved alignment for each pedal in the assembly. The invention utilizes a pedal mount block having an opening for accomodating one side of the pin about which the pedal pivots. A support member comprising a base plate has openings in the form of T configurations adapted for insertion and retention of the bottom portion of the pedal block mount which after insertion, slides into the slot of the T, where it is maintained in position by a single screw. The pedal clips and plastic bushings of the prior art assemblies are eliminated, while the flat base plate is fabricated in a single operation rather than the three step forming action associated with prior art brackets. The pedal block mounts and associated slots in the mounting bracket provide perfect alignment and registration for each pedal in the assembly, and adjustment to individual specifications of pedal location can be accommodated by merely changing the location of the openings in the base plate. Thus the instant invention comprises an improved piano pedal assembly having a substantially fewer number of less complex parts than prior art assemblies, thereby providing substantial savings in manufacturing and fabrication time and cost.

DETAILED DESCRIPTION OF A PREFERRED EMBODIMENT

Figure 1:
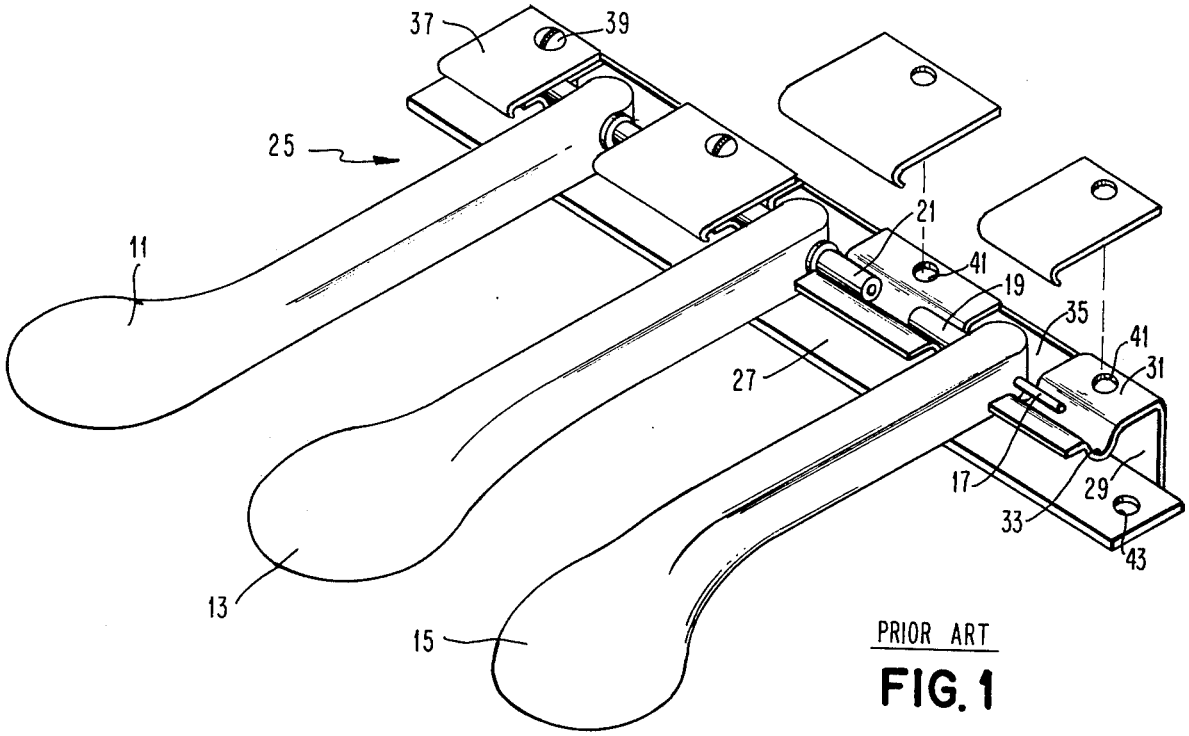
PRIOR ART FIG. 1
FIG. 1 is an exploded perspective of a prior art pedal assembly.

Referring now to the drawings and more particularly to FIG. 1 thereof, there is shown by way of illustration one example of a piano pedal assembly illustrative of conventional prior art assemblies. The assembly comprises three pedals 11, 13, 15 which are normally made or formed of sand or die cast brass or brass plating. While the actuatable end of the pedal assemblies in FIG. 1 are illustrated as round, any configuration such as that shown in FIG. 2 may be employed. Each pedal has an associated pin designated as the pivot pin which extends through both sides of the pedal such as pin 17 associated with pedal 15. The pins are inserted through the associated pedal by conventional processes such as pressing a serrated pin through the hollow extremity of the pedal. Each side of the pin is positioned within an associated plastic bushing to eliminate noise such as squeaks in pedal operation. Bushing 19, for example, is associated with one side of pin 17, while bushing 21 is associated with the pin adjacent of pedal 13.

The illustrated pedal mounting bracket 25 is a complex three sided assembly havng a flat base plate 27, a back member 29 disposed at 90° with respect to the base plate 27 and a top member 31 substantially parallel to the base plate 27 and having semicircular depressions 33 formed along the entire upper surface 31 to accommodate the pin bushings such as 19, 21. As shown, fabrication of the pedal mounting bracket 25 involves a complex three step forming operation to provide the initial flat blank, the two 90° bends and the depressions 33 in the upper surface 31 of the bracket assembly. The upper surface 31 of the bracket assembly also includes cut-out areas 35 for containing the end of the individual pedals. With the bushing clad pins inserted in pin depression 33, pedal assembly clips 37 are attached to the upper surface 31 of the bracket assembly by conventional means such as screws 39 which attach the clips to the bracket through threaded cutouts 41. Each pedal assembly clip has a width corresponding either to the distance between pedals or determined by whether it holds one or two bushing clad pins. The base plate 27 of the bracket extends beyond the upper portions on each end to permit fastening of the assembly through openings 43 to the piano. The process of fabricating the piano pedal assembly of FIG. 1 require that the base plate 27 and clips 37 be clamped or held in position prior to fastening the screws 39, a relatively difficult manual operation.

Figure 2:
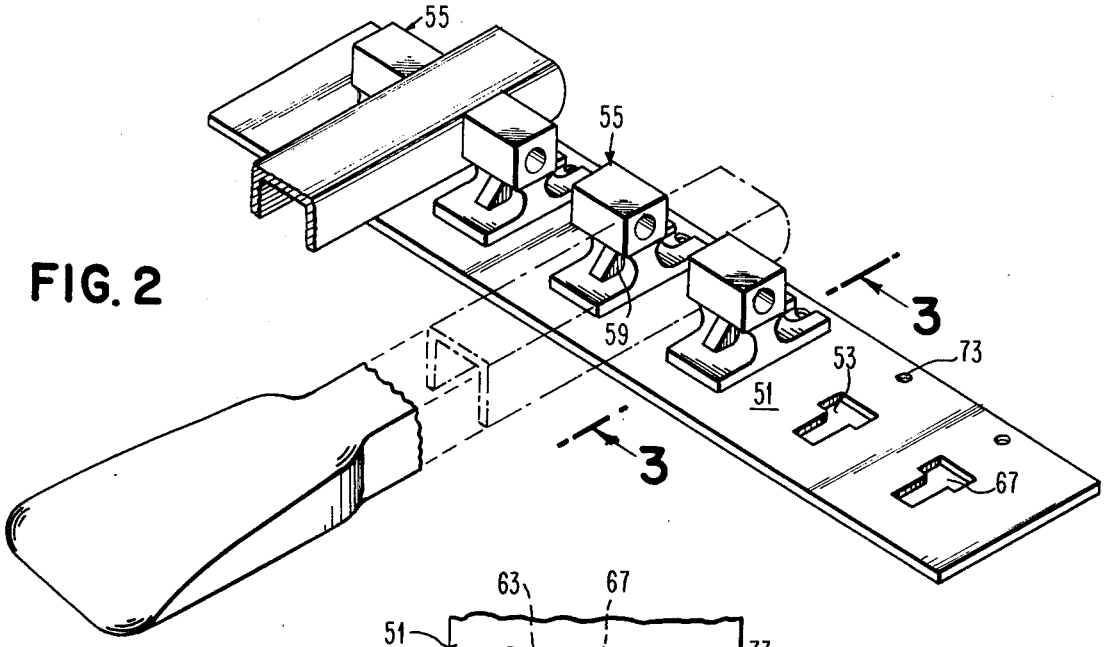
FIG. 2 is a perspective view of the present invention.

Referring now to FIG. 2, there is illustrated a perspective view of a preferred embodiment of the instant invention. The pedal assembly functionally corresponds to that shown in FIG. 1, the square toe design of the end of the pedals in FIG. 2 being considered a functional and dimensional equivalent of the round toe configuration of FIG. 1. Base plate 51 is a flat metal plate which may be stamped in a single operation. The base plate has a series of T-shaped opening or slots 53 therein, a pair of slots being associated with each pedal, individual slots being positioned on each side of the three pedals. Each slot is adapted for insertion, registration and retention of a pedal block mount 55 which is notched along its bottom portion to slide along the narrow opening of the T slot. Pedal block mounts 55 are formed as a single unit of a low friction material such as Nylon or Teflon, Nylon being employed in the preferred embodiment. As in the prior art assembly of FIG. 1, each pedal has an associated pin designated the pivot pin which extends through the openings 57 of a pair of mounting blocks to maintain the pedal in registration with its associated pair of mounting blocks. The specific configuration of the pedal mount block is more clearly shown in FIG. 3.

Figure 4:
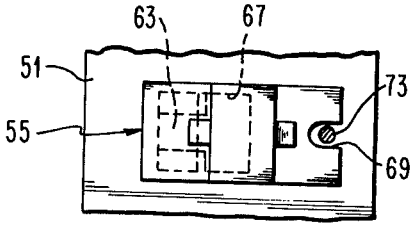
FIG. 4 is a top view of the pedal block mount illustrated in FIG. 2.
Figure 3:
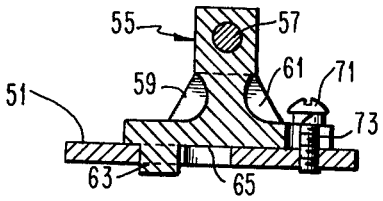
FIG. 3 is a sectional elevation view taken along the line 3—3 in FIG. 2.

Referring briefly to FIG. 3 illustrating an end view of the pedal mounting block, pedal mounting block 55 has a cylindrical opening 57 extending through the entire block adapted to contain one side of the pivot pin of the associated pedal or opposite sides of the pivot pins of adjacent pedals depending on its location. Each pedal block mount has ribbed portions 59, 61 on opposite sides thereof for added strength, and a notched portion 63 on the lower part of the block for positioning and maintaining the block mount in position within its associated T slot extends below its base and, as pointed out above, slides along the narrow portion of its associated T slot. Thus the notched portion 63 of the pedal mount block is adapted to initially fit within the upper portion 67 of the T slot 53 and as pointed out above slide along the narrow area of slot 53. The relationship between the pedal block mount and its associated slot is more clearly shown in FIG. 4 in which both the initial and final positions of the clamping portion of the mounting block are illustrated in dotted form, the mounting block moving laterally from right to left in FIG. 4. Each mounting block has an opening 69 on one end thereof. When slid into position, the mounting block is secured in the desired position by turning head 71 of screw 73 inserted through an opening in the base plate. To mount a pedal on the base plate 51, opposite ends of the pedal pin 17 (FIG. 1) would be inserted into openings 57 of an associated pair of mounting blocks 55, and the two blocks simultaneously positioned through their associated slots and attached to the base plate in the manner described above. The mounting blocks when thus attached to the base plate provide substantially perfect registration and alignment of their associated pedal and prevent any lateral shifting of the pedal in the assembly. Any distance between the pedals in the assembly can be readily accommodated by controlling the location of slots 53, a relatively simple stamping operation on a flat metal bracket. By fabricating the mounting blocks of a low friction durable material such as Nylon, lubrication requirements and bearing noises are eliminated, thereby facilitating long life.

From the above it is apparent that the instant invention represents a significant advance in the pedal assembly art, providing enhanced capability at lower component and assembly costs. While the invention has been shown with reference to a preferred embodiment thereof, it will be understood by those skilled in the art that other changes in form and detail may be made therein without departing from the spirit and scope of the invention.

What is claimed is:

1. A piano pedal assembly comprising in combination
a plurality of pedals,
a support member having a plurality of openings therein,
a plurality of mounting blocks having notched portions adapted to fit within said openings, a pair of said mounting blocks being used to support each of said pedals,
means for coupling said pedals to said mounting blocks, and
means for attaching said mounting blocks to said support member to provide registration and alignment of said pedals in said piano pedal assembly.

2. A device of the type claimed in claim 1 wherein said means for coupling said foot pedals to said mounting blocks include a pin associated with each of said foot pedals, and an opening in each of said mounting blocks adapted to accommodate said pin.

3. A device of the character claimed in claim 2 wherein said means for attaching said mounting block to said support member includes retention means for clamping said mounting blocks in the associated openings of said support member.

4. Apparatus of the type claimed in claim 1 wherein said mounting blocks are formed of a low friction material.

5. Apparatus of the type claimed in claim 4 wherein said low friction material is Nylon.

6. Apparatus of the type claimed in claim 1 wherein said support member is a base plate.

7. A piano pedal assembly comprising in combination
a plurality of pedals,
support means comprising a base plate having a plurality of openings at predetermined positions therein,
a plurality of mounting blocks,
a pair of said mounting blocks being used to support each of said pedals, and
means for attaching said mounting blocks to said support member to provide registration of said pedals with respect to said base plate,
said means comprising a portion of said mounting blocks adapted to extend into said openings and be clamped in position therein.

8. A device of the type claimed in claim 7 further comprising means for retaining said mounting blocks in position within said associated openings.

9. A device of the type claimed in claim 7 wherein said mounting blocks are composed of a low friction material compound.

10. Apparatus of the type claimed in claim 8 wherein said low friction material is Nylon.

* * * * *